US005195864A

United States Patent [19]

Drake et al.

[11] Patent Number: 5,195,864

[45] Date of Patent: Mar. 23, 1993

[54] HYDRAULIC SYSTEM FOR A WHEEL LOADER

[75] Inventors: Frank J. Drake; Bruce K. Jaecks, both of Wausau, Wis.

[73] Assignee: Case Corporation, Racine, Wis.

[21] Appl. No.: 751,862

[22] Filed: Aug. 28, 1991

[51] Int. Cl.[5] ..... B66C 23/56

[52] U.S. Cl. ..... 414/699; 414/719; 60/413; 60/469

[58] Field of Search ..... 414/699, 715, 719, 673; 60/469, 413

[56] References Cited

U.S. PATENT DOCUMENTS

| | | | |
|---|---|---|---|
| 2,672,995 | 3/1954 | Drott . | |
| 3,122,246 | 2/1964 | Freedy et al. | 414/719 X |
| 3,630,317 | 12/1971 | Jacobsson | 414/719 X |
| 3,749,269 | 7/1973 | Conrad | 414/699 |
| 4,502,708 | 3/1985 | Taplin . | |
| 4,573,592 | 3/1986 | Oliphant | 414/719 X |
| 4,658,970 | 4/1987 | Oliphant | 414/719 X |
| 4,953,723 | 9/1990 | Saotome et al. | 60/413 X |
| 4,969,562 | 11/1990 | Saotome | 60/413 X |
| 4,995,517 | 2/1991 | Saotome | 60/413 X |
| 5,034,892 | 7/1991 | Saotome | 60/413 X |
| 5,048,296 | 9/1991 | Sunamura et al. | 60/469 X |
| 5,116,188 | 5/1992 | Kuronashi et al. | 414/719 |

FOREIGN PATENT DOCUMENTS

| | | | |
|---|---|---|---|
| 57-209341 | 12/1982 | Japan | 414/719 |
| 1470499 | 4/1977 | United Kingdom | 414/673 |

OTHER PUBLICATIONS

J. I. Case Model No. 721 Wheel Loader brochure, undated.

Zettelmeyer Baumaschinen GmbH brochure, (one page) illustrating a load stabilizing system for a front end loader, undated.

Caterpillar brochure, (one page) illustrating a ride control system for a wheel loader.

Triad Equipment Corporation brochure, (2 pages) entitled "Improve Your Cycle Time With Bucket Suspension Control for Case Wheel Loaders".

Hanomag Baumschienen brochure, (6 pages) of a Systeme ALS" (no translation available).

Kolebeco brochure, (14 pages), undated.

*Primary Examiner*—Michael S. Huppert
*Assistant Examiner*—William M. Hienz
*Attorney, Agent, or Firm*—Dressler, Goldsmith, Shore, Sutker & Milnamow, Ltd.

[57] ABSTRACT

A hydraulic system for a wheel loader having an implement arranged for elevational and tilting movements relative to a frame of the loader. The hydraulic system includes selectively operable lifting and tilting circuitry for adjusting the position of the implement and a shock absorbing mechanism arranged in combination with the lift circuitry for allowing relative movement between the implement and the frame to provide a cushioning effect which reduces pitching of the loader. To inhibit inadvertent vertical displacement of the implement, the shock absorbing mechanism is responsive to an initial lifting action of the implement. In a preferred form of the invention, the shock absorbing mechanism is responsive to hydraulic conditions indicative of imminent tilting movement of the implement thereby eliminating inadvertent vertical displacement of the implement when the implement reaches a limit of its tilting travel.

21 Claims, 3 Drawing Sheets

HYDRAULIC SYSTEM FOR A WHEEL LOADER

FIELD OF THE INVENTION

The present invention generally relates to off-highway equipment and, more particularly, to a hydraulic system used to position a bucket or similar implement relative to a frame of off-highway equipment such as a wheel loader.

BACKGROUND OF THE INVENTION

A wheel loader is commonly used to load and move substantial volumes of dirt and like material from one location to another. A conventional wheel loader includes a relatively large frame which is supported for self-propelled movement over land by pairs of air-filled tires and has a bucket or implement mounted to one end thereof. The bucket or implement can be selectively elevated to a position above side panels on a truck or the like and can be selectively tilted to "dump" materials therefrom.

The bucket or implement is typically connected to forward ends of a pair of lift arms extending from and having opposite ends pivotally connected to the frame of the loader. The bucket is connected to the lift arms in a manner allowing tilting movement of the bucket about a generally horizontal axis.

Hydraulic motors generally provide the motive force for moving the bucket or implement. Typically, a pair of hydraulic motors are connected to the frame for pivoting the lift arms and thereby adjusting the elevation of the bucket. Another hydraulic motor tilts the bucket about its horizontal axis to dump the materials from the bucket.

The land or terrain over which the wheel loader moves is typically uneven, and the wheel loader has an unsprung suspension except for the air-filled tires. As the loader is driven, the uneven terrain and the bucket at one end thereof causes a pitching motion to be imparted to the loader. Having the bucket filled as the loader is driven across the field amplifies the pitching problem. The instability or vertical bounce imparted to the loader translates to poor driving comfort and makes steering and general handling conditions difficult. Accordingly, the operator is required to reduce ground speed of the loader thereby adversely effecting productivity.

In an attempt to reduce the pitching motion, some wheel loaders have been known to include a fluid accumulator in combination with the hydraulic motors used to vertically position the bucket relative to the frame. Unexpected vertical displacement of the bucket results, however, when a residual charge in the accumulator does not correspond to the fluid pressure in the hydraulic lift motors upon activation of the accumulator. As will be appreciated, unexpected vertical displacement of the bucket can have serious drawbacks during operation of the loader.

Another problem involved with wheel loaders has been observed when the bucket is tilted to dump materials therefrom. A typical loader has a linkage mechanism which connects the hydraulic dump motor to the bucket. Retracting movement of the dump motor acts to tilt the bucket. During operation, a stop limits the travel of the linkage mechanism thereby limiting tilting action of the bucket. Normally, the stroke of the hydraulic motor used to forcibly tilt the bucket is somewhat greater than the tilt travel of the bucket as limited by the stop. When the linkage mechanism reaches the limit stop, the retracting action of the hydraulic motor acting to tilt the bucket pulls the lift arms downward thereby forcing fluid out of the hydraulic lift motors and into the accumulator.

It is not uncommon for the bucket to fall about 10 inches after the bucket has been moved into its maximum tilt position. As will be appreciated, when the bucket is elevated to dump its load into a truck or the like, a 10 inch drop of the lift arms will likely impact against the side of the truck thereby jolting both the wheel loader and truck along with the operator of such equipment.

Thus, there is a need and a desire for a shock absorbing mechanism operative to absorb vibrations from the bucket thereby reducing the pitching motion and facilitating a smoother ride for the wheel loader over uneven terrain. Another object of the present invention is to inhibit inadvertent vertical displacement of the bucket during operation of the wheel loader.

SUMMARY OF THE INVENTION

In view of the above, and in accordance with the present invention, there is provided a hydraulic system for vertically positioning an implement or bucket mounted to a wheel loader frame. The hydraulic system includes hydraulic motors powered by a fluid source and connected to the frame for vertically moving the implement relative thereto. Fluid flow is directed through fluid paths and actuates the hydraulic motor to elevate the implement relative to the frame. A shock absorbing mechanism is arranged in combination with the fluid flow paths for allowing relative movement between the frame and the implement to provide a cushioning effect which reduces pitching of the loader thereby enhancing its handling characteristics as the loader is driven across the field. To minimize or eliminate inadvertent vertical movements of the bucket and call the operator's attention to the fact that the bucket is going to vertically move, the shock absorbing mechanism is responsive to initial actuation of the hydraulic motors elevating the implement or bucket relative to the frame.

The hydraulic motors for elevating the implement include a pair of linearly distendable cylinder assemblies. At opposite ends thereof, each cylinder assembly defines fluid receiving chambers whose volumes control the vertical disposition of the implement relative to the frame. In a preferred form of the invention, each cylinder assembly is connected to the frame and a lift arm. Each lift arm is pivotally connected to the frame and has the implement connected to an opposite end thereof. Another hydraulic motor is connected to the frame for tilting the implement about its horizontal axis.

A first operator control valve is connected to the fluid source and regulates fluid flow to the hydraulic motors used to elevate the implement relative to the loader frame. The first control valve is manually shiftable between: a first position to enable the hydraulic motors in a manner maintaining the elevation of the implement relative to the frame; a second position to enable the hydraulic motors in a manner raising the implement relative to the frame; and, a third position to enable the hydraulic motors in a manner lowering the implement relative to the frame.

In a preferred form of the invention, a second operator control valve is connected to the fluid source and regulates fluid flow to the hydraulic motor used to tilt the implement about its horizontal axis. The second valve is shiftable to a first position to control operation of the hydraulic motor to tilt the implement in a first direction of travel, to a second position to control operation of the hydraulic motor to hold the implement against tilting, and to a third position to control operation of the hydraulic motor to tilt the implement in a second direction of travel opposed to the first direction.

The shock absorbing mechanism includes electro/hydraulic circuitry comprised of a fluid accumulator operated under the influence of solenoid valves connected to the fluid flow path leading to the hydraulic lift motors. The fluid accumulator is operably connected to a head end of each cylinder assembly and acts in concert therewith. The fluid accumulator is enabled in response to hydraulic conditions indicative of imminent movement of the bucket. A detector is included within the electro/hydraulic circuitry for monitoring the hydraulic conditions within the hydraulic system and enabling the fluid accumulator. In a preferred form of the invention, the electro/hydraulic circuitry further includes an operator controlled switch for selectively enabling the shock absorbing mechanism.

In a most preferred form, and to inhibit the lift arms from inadvertently falling during tilting of the bucket, the electro/hydraulic circuitry further includes a monitor for allowing the shock absorbing mechanism to respond to conditions within the hydraulic system indicative of tilting movement of the bucket. Preferably, the electro/hydraulic circuitry includes pressure-responsive switches for monitoring hydraulic pressure levels during operation of the hydraulic system. Such pressure switches are movable between open and closed positions in response to pilot pressure signals indicative of fluid pressures applied to the hydraulic motors during operation of the hydraulic system.

The shock absorbing mechanism operates to allow relative movement between the lift arms and loader frame after the hydraulic motors have been enabled to elevate the implement relative to the wheel loader frame. When the shock absorbing mechanism is operated, hydraulic fluids in the hydraulic lift motors act against the accumulator. Thus, the hydraulic lift motors act as shock absorbers which cushion the up and down motion of the bucket caused by driving the loader over uneven terrain. In addition to enhancing wheel loader handling characteristics, cushioning the up and down motion of the bucket decreases wear on the loader and decreases maintenance expense, increases life of the hydraulic equipment, and substantially reduces fatigue to the operator due to the substantial reduction in swaying motion of the loader.

Notably, the shock absorbing mechanism is responsive to hydraulic conditions within the hydraulic system. By designing the electro/hydraulic circuitry to be responsive to fluid pressure levels within the hydraulic system, inadvertent lift arm drop is minimized while inherently alerting the operator that the lift arms are going to vertically move. Moreover, configuring the electro/hydraulic circuit to be responsive to imminent movement of the bucket tilting mechanism likewise avoids an unexpected vertical drop of the lift arms and minimizes damage to the lift arms and the truck bed against which the lift arms normally impact upon an inadvertent fall in their elevation.

Numerous other features and advantages of the present invention will become readily apparent from the following detailed description, the accompanying drawings, and the appended claims.

DETAILED DESCRIPTION OF THE PRESENT INVENTION

Figure 1:
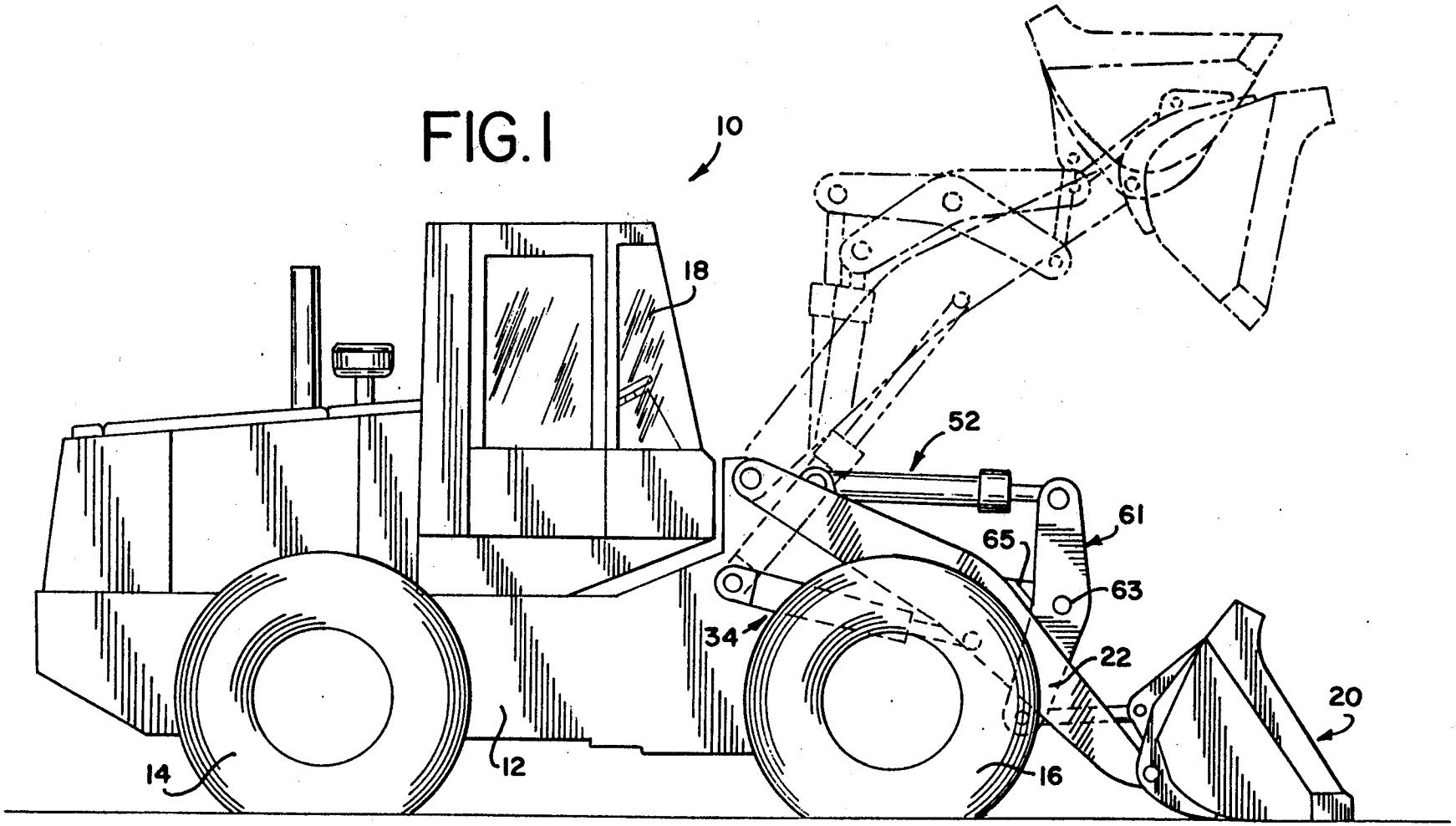
FIG. 1 is a schematic side elevational view of a wheel loader equipped with a bucket or other suitable implement shown in various elevational and tilted positions and embodying teachings of the present invention.

While the present invention is susceptible of embodiment in various forms, there is shown in the drawings and will hereinafter be described a preferred embodiment of the present invention with the understanding that the present disclosure is to be considered as an exemplification of the invention which is not intended to limit the invention to the specific embodiment illustrated.

Referring now to the drawings, wherein like reference numerals refer to like parts throughout the several views, there is schematically illustrated in FIG. 1 a wheel loader 10 which is illustrative of the type of off-highway equipment with which the present invention finds utility. Wheel loader 10 may be of the type sold by Case Corporation under Model No. 721. Suffice it to say, loader 10 includes a relatively large frame 12 supported for self-propelled movement over a field by pairs of air filled tires 14 and 16. A cab region or operator station 18 is provided intermediate fore-and-aft ends of the frame 12.

Wheel loader 10 further includes a bucket or other suitable implement 20 connected to frame 12 for movement relative thereto. As shown, a pair of lift arms 22 (only one being shown) are each pivotally connected toward one end to and on opposite sides of frame 12. The bucket 20 is pivotally connected at an opposite end of arms 22 for tilting movement relative to the frame about a generally horizontal axis. The above-described features form no substantial part of the present invention and are generally well known in the art.

In accordance with the present invention, a hydraulic system 25 is provided for elevating and/or holding the bucket 20 in different positions of adjustment relative to frame 12 and for tilting the bucket 20 relative to frame 12 to "dump" materials therefrom. The hydraulic system 25 includes hydraulic lift circuitry for controlling elevation of the bucket relative to the frame and hydraulic tilt circuitry for controlling tilting of the bucket relative to the frame.

Figure 2:
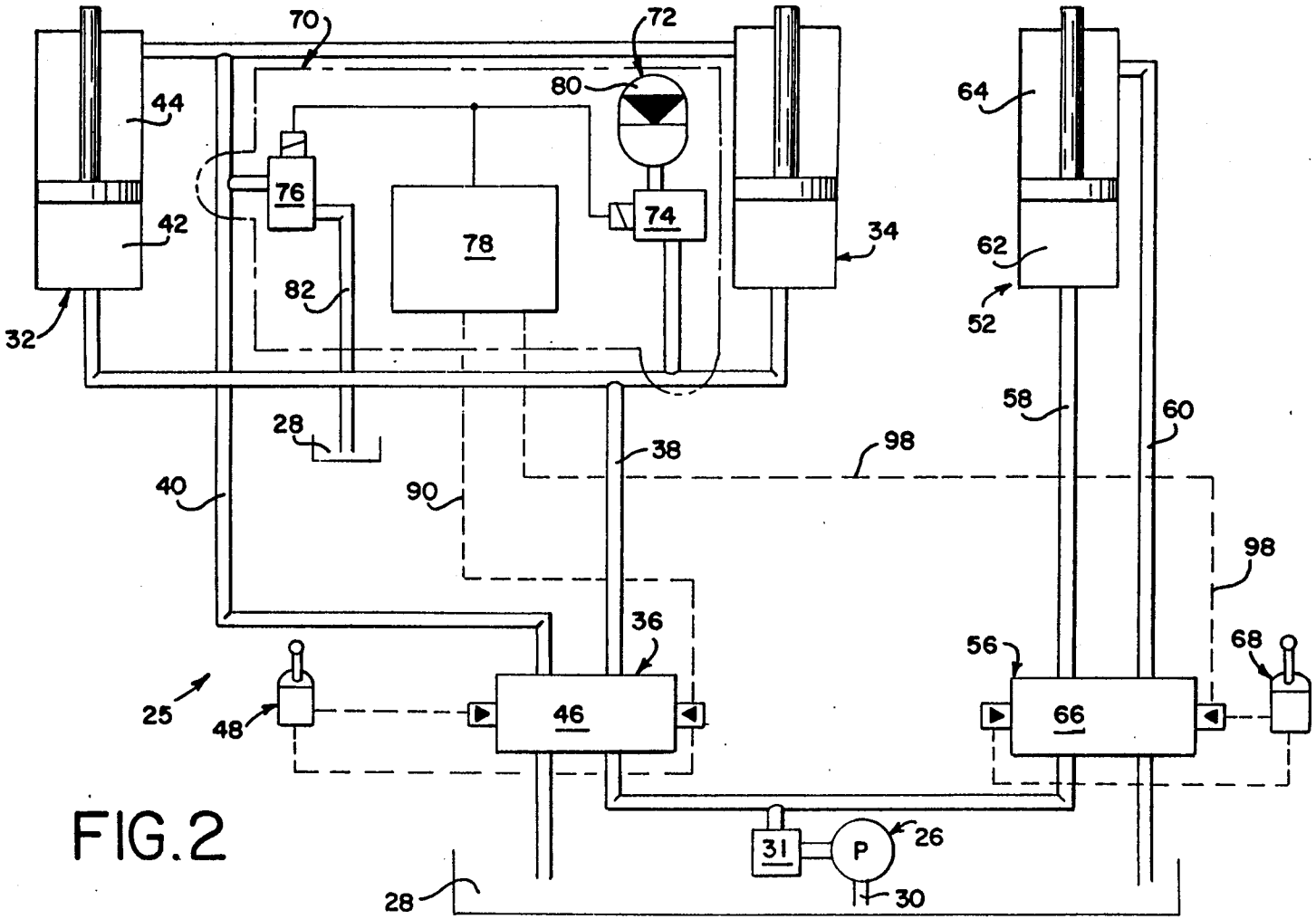
FIG. 2 is a diagrammatic view of a hydraulic system used with the wheel loader illustrated in FIG. 1 and including a shock absorbing mechanism according to the present invention.

As shown in FIG. 2, both the lift and tilt circuitry of hydraulic system 25 are powered by a common fluid source such as a motor driven hydraulic pump 26 capable of producing fluid pressure levels in the fluid system in accordance with the operational requirements of the wheel loader. Pump 26 receives operating fluid from a supply tank or reservoir 28 through a supply conduit 30. In a preferred form of the invention, a pressure regulator 31 is provided intermediate pump 26 and the lift and tilt circuitry.

The lift circuitry of the hydraulic system includes hydraulic motors 32 and 34 powered by the pump 26 and connected between frame 12 and the lift arms 22 for vertically positioning the bucket 20 relative to the frame in response to fluid flow to the motors. The hydraulic motors are selectively controlled by a control valve assembly 36 which is connected to the pump 26. Fluid conduits 38 and 40 define a fluid flow path and serve to interconnect and direct pressurized fluid between the hydraulic motors 32, 34 and the control valve assembly 36.

The hydraulic motors 32 and 34 are substantially similar to each other and, thus, only motor 32 will be described in detail. In a preferred form, each hydraulic motor comprises a conventional linearly distendable fluid cylinder assembly articulately connected between the frame 12 and each lift arm 22. Each cylinder assembly operates in response to fluid flows at head and rod ends 42 and 44, respectively, thereof. In the illustrated embodiment, the volume of the fluid receiving chambers at opposite ends of each cylinder assembly controls the elevation or vertical disposition of the implement 20 relative to the frame 12.

Control valve assembly 36 is connected to the outlet of pump 26 and to the fluid conduits 38 and 40. In a preferred form, the control valve assembly 36 includes a three-position directional valve 46 operated under the influence of a manually operated controller 48 preferably located in the cab region 18 of the loader 10. The directional valve 46 is movable between a first or neutral position, leftwardly to a second operating or lift position, and rightwardly to a third operating or lowering position.

When directional valve 46 is in a neutral position, pump 26, fluid conduit 38, and fluid conduit 40 are all isolated from one another to enable the hydraulic motors 32 and 34 to hold or maintain the bucket 20 in a selected elevational position relative to the frame 12. When valve 46 is shifted to a lift position, pump 26 is in communication over line 38 with the head end 42 of each cylinder lift assembly and the rod end 44 is open to exhaust over line 40 thereby enabling the hydraulic motors 32, 34 to raise the bucket 20 relative to the frame 12. When valve 46 is shifted to a lowering position, pump 26 in is communication over line 40 with the rod end 44 of each cylinder lift assembly and the head end 42 of each cylinder assembly is open to exhaust over line 38 thereby enabling the hydraulic motors 32, 34 to lower the bucket 20 relative to the frame. Such forms of hydraulically operated circuitry are well known, and various other circuits may be used without detracting or departing from the spirit and scope of the present invention.

The tilt circuitry of hydraulic system 25 includes a hydraulic motor 52 powered by pump 26 and operably connected to the frame 12 and bucket 20 for tilting the bucket relative to the frame about a generally horizontal axis in response to fluid flow therethrough. Hydraulic motor 52 is arranged above hydraulic motors 32, 34 and is selectively controlled by a control valve assembly 56 which is connected to the pump 26.

The hydraulic motor 52 comprises a linearly distendable fluid cylinder assembly operable in response to fluid flows at head and rod ends 62 and 64, respectively, of the cylinder assembly. In a most preferred form, the head and rod ends 62 and 64 of the cylinder assembly each define a fluid receiving chamber whose volume controls the tilt position of the bucket relative to the frame.

As shown in FIG. 1, a conventional linkage mechanism 61 including a pivotally mounted lever arm 63 carried between the lift arms 22 interconnects the hydraulic motor 52 and the bucket 20. As will be understood, extension/retraction of motor 52 causes the lever arm 63 to pivot thereby tilting the bucket about its horizontal axis to dump materials therefrom. In the illustrated embodiment, a stop 65 is provided for limiting retracting movement of lever arm 63 thereby limiting pivotal tilting movement of the bucket 20 relative to frame 12 when materials are "dumped" therefrom.

Returning to FIG. 2, control valve assembly 56 is connected to the outlet of pump 26 and to fluid conduits 58 and 60. In a preferred form, the control valve assembly 56 includes a three-position directional valve 66 operated under the influence of a manually operated controller 68 preferably located in the cab region 18 of the loader. The control valve 66 is movable between a first or neutral position, leftwardly to a second operating or "dump" position and rightwardly to a third operating position.

When valve 66 is positioned in a neutral position, pump 26, fluid conduit 58, and fluid conduit 60 are all isolated from one another to enable the hydraulic motor 52 to hold or maintain the bucket in a selected tilted position relative to the frame. When valve 66 is shifted to a "dump" position, pump 26 is connected over line 60 with the rod end 64 of the cylinder assembly and head end 62 is open to exhaust thereby enabling retraction of the hydraulic motor 52 in a manner moving the conventional linkage mechanism 61 to tilt the bucket about its horizontal axis and "dump" materials therefrom. When valve 66 is shifted to a third position, pump 26 is connected over line 58 with the head end 62 of the cylinder assembly and the rod end 64 is open to exhaust thereby enabling extension of the hydraulic motor 52 to conventional linkage mechanism 61 to tilt the bucket in an opposite direction about the horizontal axis of the bucket. As mentioned above, such forms of hydraulically operated circuits are well known and various other circuits including more than one hydraulic cylinder may be used without departing or detracting from the spirit and scope of the present invention.

The hydraulic system 25 further includes shock absorbing means 70 arranged in parallel with the lift circuitry of the hydraulic system for providing a cushioning effect between the bucket 20 and frame 12 thereby enhancing handling characteristics of the loader. The shock absorbing means 70 preferably comprises electro/hydraulic circuitry including fluid energy storage means 72 operated under the influence of electrically operated solenoid valves 74 and 76 connected to the fluid conduits 38 and 40, respectively. The solenoids 74, 76 are operated in response to signals derived in an electrical system 78 forming part of the shock absorbing means 70. As will be appreciated, the shock absorbing means 70 can equally function with a single solenoid serving a dual function and some minor modifications to the fluid conduits extending therefrom and thereto.

In a preferred form of the invention, the fluid energy storage means 72 comprises a fluid accumulator 80 which is precharged to an appropriate operating pressure. In a most preferred form of the invention, accumulator 80 includes a conventional nitrogen/oil accumulator. Accumulator 80 is selectively connected to the fluid conduit 38 through solenoid valve 74.

Solenoid valve 76 selectively opens conduit 40 to exhaust. A conduit 82 is adapted to direct fluid received from valve 76 to the reservoir 28.

Figure 3:
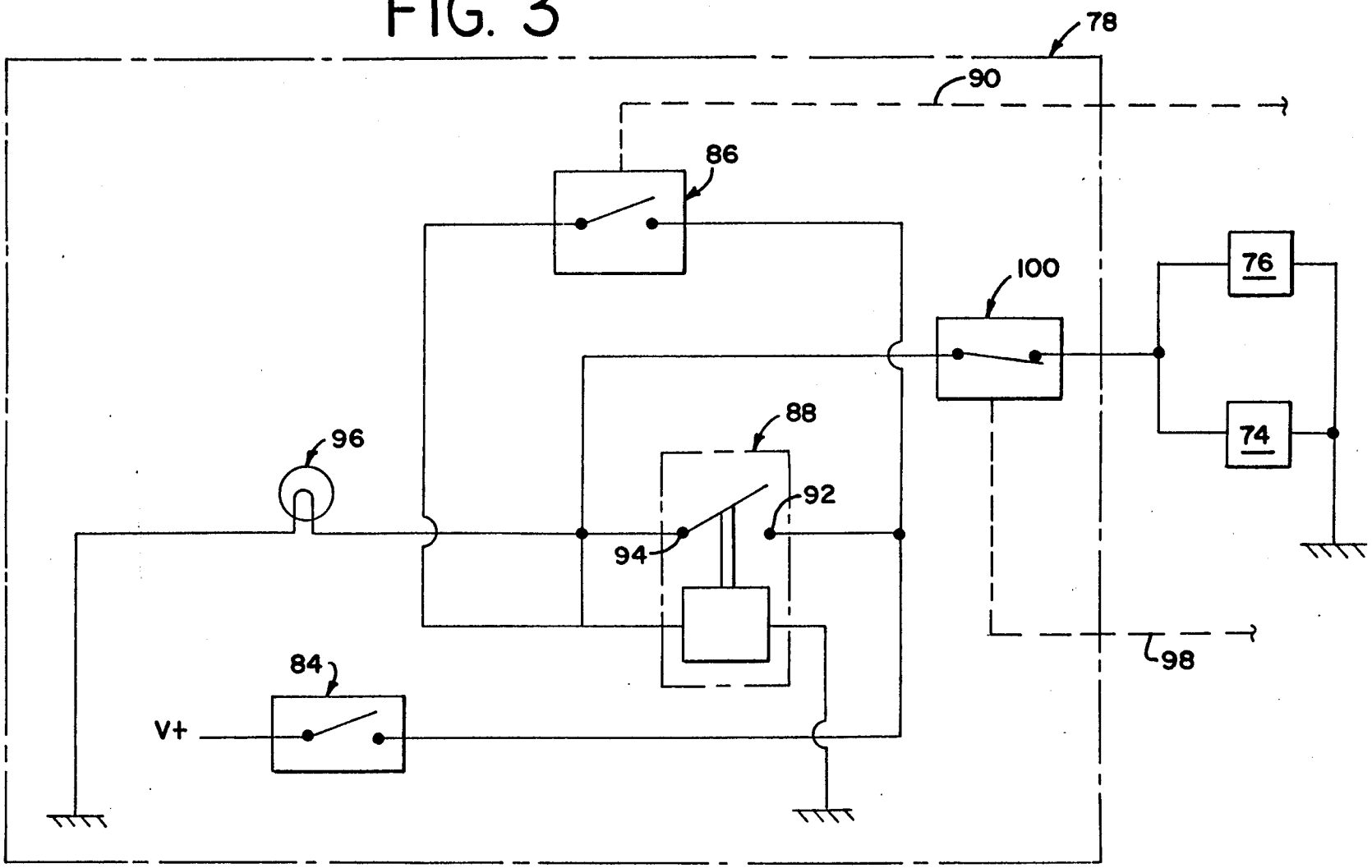
FIG. 3 is a diagrammatic view of an electrical system forming part of the present invention.

As schematically illustrated in FIG. 3, the electrical system 78 of the electro/hydraulic circuit is preferably designed such that the shock absorbing means 70 is responsive to hydraulic conditions affecting operation of the hydraulic motors 32, 34 and 52. The term "hydraulic conditions" is meant to include hydraulic pressure levels within the hydraulic system 25 for shifting the direction valves 46 and 66 and operating the respective hydraulic motors used to position the bucket or element during operation of the loader.

In a preferred form, the electrical system 78 is responsive to manual actuation by the operator. As shown, the electrical system includes a manually actuated ON/-OFF switch 84. Switch 84 is preferably located in the cab region 18 of the loader and is operably connected to a suitable power source V+ on the loader. In a preferred form of the invention, switch 84 is connected in series with a pressure responsive ON/OFF switch 86. As shown, switch 86 is electrically connected to a normally open latching relay 88 and to solenoid valves 74 and 76.

As schematically represented in FIG. 2, in a preferred form of the invention, shifting movement of the directional valve 46 of control valve assembly 36 is facilitated by pilot pressure signals delivered over pilot lines 90. In operation, pressure levels in pilot line 90 indicate the fluid pressure levels applied to actuate hydraulic motors 32 and 34.

Returning to FIG. 3, switch 86 is preferably designed as a normally open switch which responds to the magnitude of pilot pressure signal of pilot line 90. In a preferred form of the invention, switch 86 closes in response to a pressure level higher than that required to fully stroke the directional valve 46 into a lift position. Accordingly, an intentional effort to adjust the elevation of bucket 20 is required before switch 86 closes to enable the shock absorbing mechanism 70.

The normally open latching relay includes terminals 92 and 94. Terminal 92 is connected to manually operated switch 84. Terminal 94 is connected to: solenoid valves 74 and 76; switch 86; and signal means 96. Signal means 96 is preferably in the form of an indicator light which is arranged in the cab region 18 of the loader for signaling enablement of the shock absorbing means 70.

Returning to FIG. 2, in a preferred form of the invention, shifting the directional valve 66 of control valve assembly 56 is likewise facilitated by pilot pressure signals delivered over pilot line 98. In operation, pressure levels in pilot line 98 indicate fluid pressure levels applied in the bucket dump line. The apparatus for providing pilot pressure signals to facilitate shifting of the directional valves 46 and 66 is well known in the art.

In a preferred form of the invention, and to inhibit the loader lift arms 22 from falling during dumping of the bucket 20, the electrical system 78 of the electro/hydraulic circuit includes another pressure responsive ON/OFF switch 100. Switch 100 is arranged to inhibit fluid communication between accumulator 80 and the motors 32, 34 in response to hydraulic conditions indicative of imminent movement of the linkage mechanism 61 in a direction intended to "dump" the bucket or implement.

As shown in FIG. 3, switch 100 is operably arranged between solenoid valves 74, 76 and switch 86 and latch relay 88. Switch 100 is preferably designed as a normally closed switch which responds to the magnitude of pilot pressure signals of pilot line 98. In a preferred form of the invention, switch 100 opens in response to increasing pressure at a level substantially lower than that required to initiate movement of directional valve 66 and, hence, hydraulic motor 52.

During operation of the loader, selective movement of controllers 48 and 68 will position the respective directional valves 46 and 66 thereby controlling fluid flow to the hydraulic motors 32, 34 and 52. As will be appreciated, fluid flow in conduits 38 and 40 regulate operation of the hydraulic motors 32 and 34 in a manner controlling elevation of the bucket 20 relative to the frame. Fluid flow in conduits 58 and 60 regulate operation of the hydraulic motor 52 and thereby the tilt position of the bucket about its horizontal axis. In a neutral position, control valve assemblies 36 and 56 inhibit flow through the conduits leading therefrom and thereby hold or maintain the bucket 20 in an adjusted position relative to the frame.

During operation of the wheel loader 10, and in other types of hydraulically operated load handling equipment, the shocks imparted to the frame 12 and through it to the operator as the loader travels over uneven terrain are quite severe. The bucket 20, whether loaded or unloaded, further adds shock loads to the frame thus adding instability to the loader during its operation.

The shock absorbing means 70 of the present invention provides a cushioning effect between the bucket and frame 12 to substantially reduce such shocks or other shocks as may be imparted by the load upon the loader. When the shock absorbing means is operational, accumulator 80 of the electro/hydraulic circuit is connected through solenoid valve 74 to fluid conduit 38, and fluid conduit 40 is open to exhaust as through solenoid valve 76. As such, the hydraulic motors 32 and 34 operate under the influence of the pressurized fluid in the accumulator. When the shock absorbing means 70 is enabled and valve 46 is positioned in neutral, the hydraulic motors 32 and 34 effectively act as shock absorbers allowing relative movement between the bucket 20 and frame 12 thereby cushioning the up and down motion of the bucket caused by driving the loader 10 over uneven terrain.

With the present invention, operation of the shock absorbing means 70 is effected in several ways. In a preferred form of the invention, the electro/hydraulic circuit includes a pressure responsive switch 86 for initially inhibiting fluid communication between the fluid accumulator 80 and the lift circuitry until the operator purposefully moves controller 48 to provide sufficient fluid pressure to motors 32, 34 to elevate the bucket relative to the frame. By arranging the switch 86 to initially respond a pressure level higher than that required to stroke directional valve 46 into a lift position means that the lift arms 20 are moving up when the accumulator 80 is actuated. This not only minimizes or eliminates inadvertent vertical movement of the lift arms 22, but likewise calls the operator's attention to imminent bucket movement because the operator is required to shift the controller 48 sufficiently to establish a relatively high level of fluid pressure in the pilot line 90 to effect closure of switch 86.

In the illustrated embodiment, the electro/hydraulic circuitry of the shock absorbing means 70 is enabled through closure of manually operated master switch 84 which connects the electric system 78 to a suitable voltage source. The provision of master switch 84 allows the shock absorbing means to be selectively operated from the cab region during operation of the loader. Moreover, the signal device 96 provides a visual indication that the shock absorbing means 70 has been enabled.

When the lift arms 22 are at their full height and the bucket 20 is tilted, lever 63 of linkage 61 impacts against the stop 65 to limit the tilt travel of the bucket. As will be understood, with the lever 63 against stop 65, retraction of hydraulic motor 52 normally drives the lift arms 22 downward and forces fluid from the head ends 42 of the cylinder assemblies into the accumulator 80. As will be appreciated, forcing the lift arms 22 downward causes them to impact against the side panel of the truck during a loading procedure thereby adding further shock loads to the loader.

The electro/hydraulic circuitry of the present invention has been designed for inhibiting fluid communication between the accumulator 80 and the hydraulic motors 32 and 34 in response to hydraulic conditions indicative of imminent movement of the tilting linkage mechanism 61 to dump the bucket whereby preventing fluid flow into the accumulator 80 and thereby inhibiting inadvertent vertical drop of the lift arms and the bucket.

In the illustrated embodiment, pressure switch 100 monitors the pressure level of pilot line 98 during its operation. By providing that switch 100 is responsive to a pressure level which is lower than that required to stroke directional valve 66 into position to tilt the bucket means that the solenoids 74 and 76 of the shock absorbing means are disabled before the bucket is tilted. Therefore, fluid at the head end 42 of each of the hydraulic lift motors 32, 34 is prevented from reaching the accumulator 80 thereby maintaining the lift arms 22 in the adjusted position chosen by the operator. When the pressure levels in the pilot line 98 return to normal, the pressure switch 100 again closes, and the shock absorbing means 70 is returned to its operable state.

Notably, the shock absorbing means 70 of the present invention is initially responsive to a lifting action of the implement and momentarily deactivates when the bucket is tilted to dump materials therefrom. Although the shock absorbing means of the present invention is particularly beneficial in road handling devices where the load is being transported over uneven grounds, it is equally applicable to other hydraulically operated load suspending devices where it is desirable to eliminate shocks from load to the load carrying support.

From the foregoing, it will be observed that numerous modifications and variations can be effected without departing from the true spirit and scope of the novel concept of the present invention. It will be appreciated that the present disclosure is intended as an exemplification of the invention, and is not intended to limit the invention to the specific embodiment illustrated. The disclosure is intended to cover by the appended claims all such modifications as fall within the scope of the claims.

What is claimed is:

1. A hydraulic system for vertically positioning an implement relative to a frame of a wheeled loader adapted to be driven over a field, said implement being carried at forward ends of a pair of lift arms pivotally connected to said frame, said hydraulic system comprising:

a pressurized fluid source;

hydraulic motor means connected between said frame and said lift arms for causing said implement to be lifted vertically relative to the frame in response to fluid flow to said motor means;

manually operated control valve means connected to said fluid source for selectively controlling fluid flow to said motor means;

fluid conduits interconnecting and directing fluid flow between said valve means and said motor means; and manually actuated shock absorbing means including electro/hydraulic circuitry arranged in parallel with said fluid conduits, the electro/hydraulic circuitry of said shock absorbing means including fluid pressure responsive switch means switchable from a first state to a second state under the influence of pilot line pressures and upon initial lift of said implement in response to manual actuation of said control valve means such that when said switch means is in said first state, and the shock absorbing means has been manually actuated, the shock absorbing means is operatively disconnected from the hydraulic motor means thus blocking fluid flow in the fluid conduits, and when said switch means is switched into said second state, and the shock absorbing means is manually actuated, relative movement between said frame and said implement is allowed by providing fluid flow through said conduits to provide a dampening effect thereby enhancing handling characteristics as the loader is driven across a field.

2. The hydraulic system according to claim 1 with said control valve means being manually shiftable between a first position to enable said motor means in a manner maintaining the vertical disposition of said implement relative to said frame, a second position to enable said motor means in a manner raising said implement relative to said frame, and a third position to enable said motor means in a manner lowering said implement relative to the frame.

3. The hydraulic system according to claim 2 wherein said electro/hydraulic circuitry further includes a pressurized fluid accumulator operated under the influence of solenoid valve means arranged in association with said fluid conduits.

4. The hydraulic system according to claim 1 wherein said hydraulic motor means includes a pair of fluid cylinder assemblies, with each cylinder assembly being linearly actuatable in response to fluid flow at head and rod ends of each cylinder.

5. A hydraulic system for vertically positioning an implement mounted to a frame of a loader adapted to be driven across terrain, said hydraulic system comprising:

a fluid source;

hydraulic motor means powered by said fluid source and connected to said frame for vertically moving said implement relative thereto;

means defining a flow path leading to and from said hydraulic motor means;

positionable control valve means connected between said fluid source and said flow path means for selectively controlling actuation of said hydraulic motor means and thereby controlling the vertical position of said implement relative to said frame in response to positioning movements of the valve means; and shock absorbing means including electro/hydraulic circuitry arranged in parallel with said flow path means, the electro/hydraulic circuitry of said shock absorbing means comprising switch means arranged on the loader and switchable between a first state wherein said shock absorbing means is operatively disconnected from said hydraulic motor means and a second state wherein the shock absorbing means is operatively connected to said hydraulic motor means to allow relative movement between said frame and said implement and provide a cushioning effect to enhance handling characteristics as the loader is driven to across a field, said switch means being switched in response to intentional movement of said control valve means to affect an initial lift of said implement relative to said frame thereby eliminating inadvertent vertical movement of the implement relative to the frame.

6. The hydraulic system according to claim 5 wherein said hydraulic motor means includes a pair of cylinder assemblies, with each cylinder assembly defining fluid receiving chambers whose volume controls the vertical disposition of the implement relative to said frame.

7. The hydraulic system according to claim 6 wherein said electro/hydraulic circuitry includes fluid energy storage means operably connected through said flow path means to a fluid receiving chamber of each cylinder assembly.

8. The hydraulic system according to claim 5 wherein said electro/hydraulic circuitry further includes manually operable switch means for enabling operation of said shock absorbing means.

9. The hydraulic system according to claim 5 wherein said electro/hydraulic circuitry further includes accumulator means arranged and operably connected in parallel with said flow path means.

10. The hydraulic system according to claim 5 wherein said electro/hydraulic circuitry further includes latching means for maintaining said shock absorbing means enabled after said switch means switches to the second state in response to initial vertical lift of said implement relative to said frame.

11. A hydraulic system for a wheeled loader having a frame adapted for movement over a field, said loader further including an implement connected thereto for vertical and tilting movements relative to the frame, said hydraulic system comprising:

a pressurized fluid source;

first hydraulic motor means connected to said frame for elevating said implement relative to said frame in response to fluid flow thereto;

second hydraulic motor means connected to said frame for tilting said implement in response to fluid flow thereto;

first operator controlled valve means connected to said fluid source for regulating fluid flow to said first hydraulic motor means thereby controlling the vertical position of said implement;

second operator controlled valve means connected to said fluid source for regulating fluid flow to and from said second hydraulic motor means thereby controlling the tilt position of said implement;

fluid conduits interconnecting and directing fluid between each of said valve means and the respective motor means controlled thereby; and shock absorbing means including electro/hydraulic circuitry arranged in parallel with the fluid conduits interconnecting the first valve means and the first hydraulic motor means, the electro/hydraulic circuitry of said shock absorbing means including means arranged on the loader for enabling said shock absorbing means in response to a signal indicative of initial lift movement of the implement as regulated through the first operator controlled valve means, said electro/hydraulic circuitry further including detection means for controlling operation of said shock absorbing means and switchable between first and second states, said detection means being effective in a first state to allow fluid communication between said shock absorbing means and the first hydraulic motor means to enhance operational characteristics of the loader and which switches to a second state in response to imminent tilting movements of the implement, said detection means being effective in said second state to effectively disconnect the shock absorbing means from the first hydraulic motor means thus blocking fluid flow through the fluid conduits thus maintaining the preselected elevation of the implement relative to the frame.

12. The hydraulic system according to claim 11 wherein said first operator controlled valve means is shiftable to: a first position to control operation of said first hydraulic motor means to lift the implement relative to the frame; a second position to control operation of said first hydraulic motor means to maintain the vertical disposition of said implement relative to the frame; and a third position to control operation of said first hydraulic motor means to lower the implement relative to the frame.

13. The hydraulic system according to claim 11 wherein said second operator controlled valve means is shiftable to: a first position to control operation of said second hydraulic motor means to tilt said implement in a first direction of travel; a second position to control operation of said second hydraulic motor means to hold the implement against tilting; and a third position to control operation of said second hydraulic motor means to tilt said implement in a second direction of travel opposed to said first direction.

14. The hydraulic system according to claim 11 wherein said first hydraulic motor means includes a pair of cylinder assemblies, each cylinder assembly being linearly distendable in response to fluid flows at head and rod ends thereof.

15. The hydraulic system according to claim 14 wherein the signal responsive means of said electro/hydraulic circuitry includes pressure responsive means movable between open and closed positions in response to a pilot pressure signal.

16. The hydraulic system according to claim 15 wherein said pressure responsive means comprises on/-off switch means urged toward one position by the pilot pressure.

17. The hydraulic system according to claim 11 wherein said second hydraulic motor means includes a cylinder assembly which is linearly distendable in response to fluid flows at head and rod ends thereof.

18. The hydraulic system according to claim 17 wherein said detection means of said electro/hydraulic circuitry includes pressure responsive means movable between open and closed positions in response to a pilot pressure signal.

19. The hydraulic system according to claim 18 wherein said pressure responsive means comprises on/-off switch means urged toward one position by the pilot pressure.

20. A hydraulic system for a wheel loader having a frame adapted for movement over a field, said loader further including an implement connected thereto for vertical and tilting movements relative to said frame, said hydraulic system comprising:

a pressurized fluid source;

first operative means connected to said fluid source for selectively elevating said implement relative to said frame;

second operative means connected to said fluid source for selectively tilting said implement in opposite directions of travel and for maintaining said implement in a selected position; and shock absorbing means including fluid accumulator means operably arranged in fluid communication with said first operative means for providing a cushioning effect between the implement and the frame, said shock absorbing means including means for inhibiting fluid communication between said accumulator means and said first operative means in response to hydraulic conditions associated with said second operative means and which indicate imminent tilting movement of the implement thereby inhibiting an inadvertent vertical drop of said implement upon said implement reaching its limit of tilting travel by preventing fluid flow into said accumulator means.

21. The hydraulic system according to claim 20 wherein said shock absorbing means further includes means for inhibiting fluid communication between said accumulator means and said first operative means until a predetermined fluid pressure is initially provided to said first operative means.

* * * * *